US008658933B2

(12) United States Patent
Gentsch

(10) Patent No.: US 8,658,933 B2
(45) Date of Patent: Feb. 25, 2014

(54) SWITCHING DEVICE WITH A VACUUM INTERRUPTER CHAMBER

(75) Inventor: Dietmar Gentsch, Ratingen (DE)

(73) Assignee: ABB Technology AG, Zurich (CH)

( * ) Notice: Subject to any disclaimer, the term of this patent is extended or adjusted under 35 U.S.C. 154(b) by 383 days.

(21) Appl. No.: 12/611,548

(22) Filed: Nov. 3, 2009

(65) Prior Publication Data

US 2010/0108643 A1 May 6, 2010

Related U.S. Application Data

(63) Continuation of application No. PCT/EP2008/003494, filed on Apr. 3, 2008.

(30) Foreign Application Priority Data

May 3, 2007 (DE) ..... 10 2007 021 091

(51) Int. Cl.
*H01H 33/66* (2006.01)

(52) U.S. Cl.
USPC ..... 218/124; 218/120; 218/154

(58) Field of Classification Search
USPC ..... 218/118, 120, 123–126, 130–133, 140, 218/153, 154
See application file for complete search history.

(56) References Cited

U.S. PATENT DOCUMENTS

| | | | | |
|---|---|---|---|---|
| 2,886,671 | A * | 5/1959 | Steward et al. | 218/119 |
| 3,405,245 | A * | 10/1968 | Ito et al. | 218/126 |

FOREIGN PATENT DOCUMENTS

| | | |
|---|---|---|
| DE | 33 44 376 | 6/1985 |
| DE | 38 11 833 | 10/1989 |
| DE | 197 56 308 C1 | 3/1999 |
| DE | 102 38 950 | 3/2004 |
| EP | 1 022 759 A | 7/2000 |

OTHER PUBLICATIONS

Translation of Lorenz et al. [DE 197 56 308], Mar. 1999.*
Translation of Peche, Gerhard Dr Ing [DE 3811833], Oct. 1989.*
International Search Report for PCT/EP2008/003494 completed Jul. 29, 2008.
Office Action issued in corresponding German Application No. 10 2007 021 091.6-34 dated Dec. 16, 2009.
International Preliminary Report on Patentability (Form PCT/IB/373) and the Written Opinion of the International Searching Authority (Form PCT/ISA/237) issued in corresponding International Application No. PCT/EP2008/003494 dated Nov. 3, 2009, and an English Translation thereof dated Dec. 7, 2009.

* cited by examiner

*Primary Examiner* — Amy Cohen Johnson
*Assistant Examiner* — Marina Fishman
(74) *Attorney, Agent, or Firm* — Buchanan Ingersoll & Rooney PC

(57) ABSTRACT

The disclosure relates to a switching device with a vacuum interrupter chamber in which at least one moving contact piece is arranged. To considerably increase the switching rating and the dielectric strength, the disclosure proposes that two series-connected contact arrangements with a total of two contact levels which can be opened are arranged within a vacuum interrupter chamber.

19 Claims, 2 Drawing Sheets

SWITCHING DEVICE WITH A VACUUM INTERRUPTER CHAMBER

RELATED APPLICATIONS

This application claims priority as a continuation application under 35 U.S.C. §120 to PCT/EP2008/003494, which was filed as an International Application on Apr. 30, 2008 designating the U.S., and which claims priority to German Application 10 2007 021 091.6 filed in Germany on May 3, 2007. The entire contents of these applications are hereby incorporated by reference in their entireties.

FIELD

The present disclosure relates to a switching device with a vacuum interrupter chamber in which at least one moving contact piece is arranged.

BACKGROUND INFORMATION

Vacuum interrupter chambers are known to have a drive or a drive capability for each disconnection movement (breaker gap). Contact pieces are located in a vacuum interrupter chamber (VK) for this purpose. One contact piece is firmly installed in the vacuum interrupter chamber, and one contact piece is arranged such that it can move on a supply line. The movement of the contact piece which is arranged in the vacuum interrupter chamber is produced via the supply line and a bellows. Furthermore, when the switching apparatus is required to be free of restrikes, two breaker gaps can be connected in series to form two vacuum interrupter chambers.

Known vacuum interrupter chambers (VK) can be equipped with one breaker gap, and are predominantly standardized.

If vacuum interrupter chambers with increased dielectric strength after load or power switching operations are utilized, large separations are involved within an interrupter chamber and, of course, this also applies to the separation (the disconnection movement) between the contact pieces.

If a switching device is required to be free of restrikes, then breaker gaps are in some cases connected in series. The two vacuum interrupter chambers must, however, be driven separately. This can be done by means of two switching devices or by means of one switching device with a lever system (transmission).

If, for example, two vacuum interrupter chambers are chosen, the technical complexity of the unit is high, which increases costs and manufacturing ease. A further restriction is the comparatively large volume which is required at the moment for a double vacuum-interrupter chamber arrangement. If switching devices are required for the field of load-interrupter circuit breakers or for capacitive switching, safe disconnection (small number of restrikes) is required.

SUMMARY

An exemplary embodiment provides a switching device comprising a vacuum interrupter chamber in which at least one moving contact piece is arranged. Two series-connected contact arrangements with a total of two contact levels which are configured to be opened are arranged within a vacuum interrupter chamber.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Figure 1:
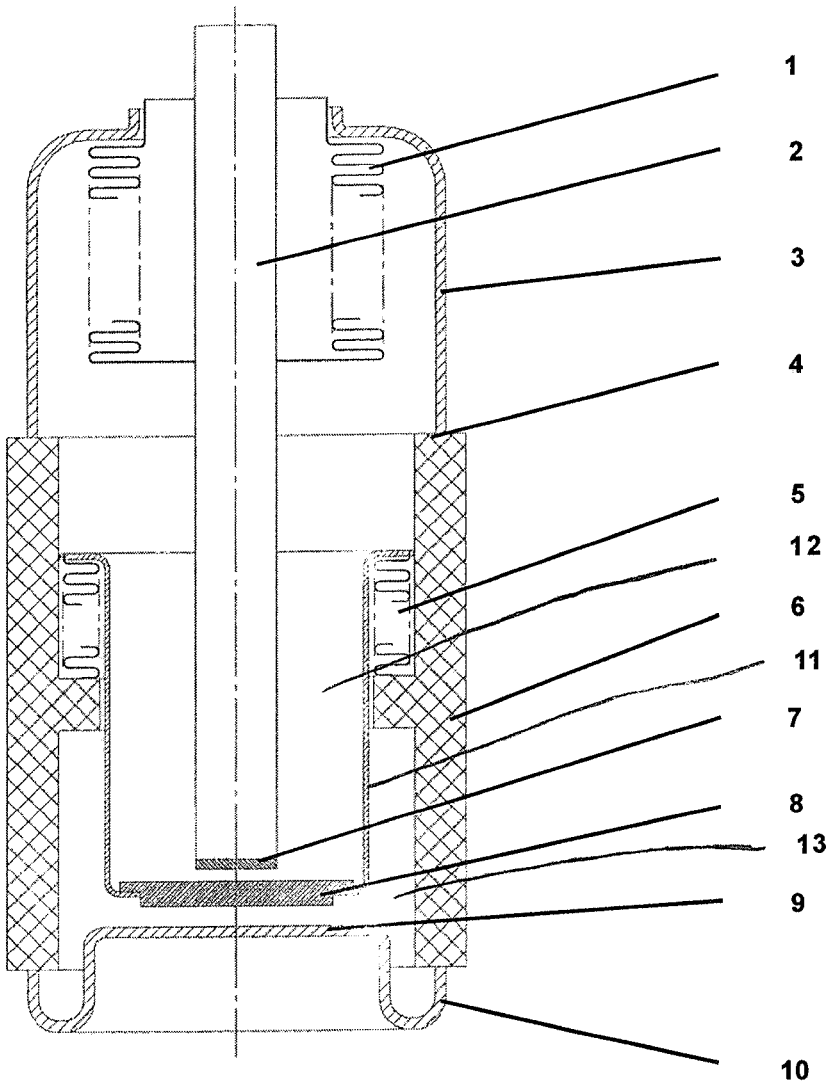
FIG. 1 shows a first exemplary embodiment of a load-interrupter circuit breaker.

Exemplary embodiments of the present disclosure provide a switching device having an increased switching rating and dielectric strength.

According to an exemplary embodiment of the present disclosure, there is the physical provision of a series contact within a vacuum interrupter chamber, by arranging two series-connected contact arrangements with a total of two contact levels which can be opened within a vacuum interrupter chamber. In this case, the two series contacts can be arranged within one vacuum interrupter chamber. This exemplary arrangement considerably improves the switching performance, especially in the context of the dielectric strength.

According to an exemplary embodiment, a common drive is provided to act on the two contacts.

According ton an exemplary embodiment, the two contacts can be formed via three contact pieces.

Another exemplary embodiment provides that one of the contact pieces is positively directly driven via the drive, while the other contact piece is driven indirectly by a spring force and moves synchronously or lags in at least one operating direction.

An exemplary embodiment provides that the synchronous or lagging contact piece is electrically floating. This represents a major improvement in terms of reliable arc quenching.

Another exemplary embodiment provides that the synchronous or lagging contact piece is surrounded by an arrangement in the form of a cup.

According to another exemplary embodiment, the arrangement which is in the form of a cup is integrally or at least firmly connected to the contact piece.

In accordance with an exemplary embodiment, the arrangement which is in the form of a cup is provided with an opening through which one contact piece is arranged, with this contact piece having effective contact faces on both sides.

In another exemplary embodiment, a material whose conductivity is less than that of copper is used for the supply line.

In this case, at least one of the two supply lines can be made of copper.

Another exemplary embodiment provides that a further inner interrupter chamber can be located within the outer vacuum interrupter chamber and be arranged in it such that the two resultant contacts are connected in series in the breaker gap.

Various material combinations are advantageous for the contact pieces. By way of example, at least one of the contact pieces is made of a copper-chromium alloy.

One specific material combination in which the materials are matched to one another is for one of the contacts or the contact faces of one contact to be made of a tungsten-copper alloy or of a tungsten-carbide-silver alloy, with the contact pieces of the other contact being made of a copper-chromium alloy.

A further moving component is located within the vacuum interrupter chamber, in order to integrate two breaker gaps in only one vacuum interrupter chamber and only one externally driven supply line. Upon disconnection, movement is introduced to the vacuum interrupter chamber via the supply line (the switching side). During disconnection, one contact point is opened first of all and, once the first disconnection movement has been completed, the second disconnection movement takes place above the moving component in the vacuum interrupter chamber, see FIG. 1 and FIG. 2. Once the complete disconnection movement has been completed, both breaker gaps are open. This arrangement involves a longer contact movement (the sum of the two isolating gaps) of course by the switching device (and the moving supply line).

If two separate vacuum interrupter chambers are used, e.q., an inner chamber (12) and an outer chamber (13), then the contact force is applied to each vacuum interrupter chamber and twice the contact pressure force is therefore involved. In the case of integrated breaker gaps, the two breaker gaps can be connected in series, and a switching device need apply only the standard contact pressure force for one vacuum interrupter chamber.

The arrangement, in which the central contact area (11) is formed by an arrangement which is in the form of a cup, or is surrounded by it, and in which it is kept electrically floating, has enormous advantages both with respect to arc quenching and with respect to the dielectric strength achieved in this way.

FIG. 1 shows an exemplary load-interrupter circuit breaker-vacuum interrupter chamber (3) with two integrated breaker gaps between the contact pieces (7-8 and 8-9). One side of the vacuum interrupter chamber (e.g., inner chamber (12)) is equipped with a moving supply line (2). The supply line (2) and the contact piece (7) as well are moved within the vacuum interrupter chamber via a bellows (1). An isolator (6) provides the isolation between the components (4) and ((10), fixed-contact side) of the vacuum interrupter chamber. During disconnection, the supply line (2) is first of all moved together with the component (8), which is arranged such that it can move in the vacuum interrupter chamber. The component (8) is connected to a spring component (5) via an edge flange on the isolator (6). The prestressing allows the contact movement (8-9). Once a preset contact movement of the breaker gap (8-9) has been reached, the breaker gap (7-8) opens, and the second contact gap is opened. The movement of the component (8) can be limited by this edge flange or by an additional edge flange.

Figure 2:
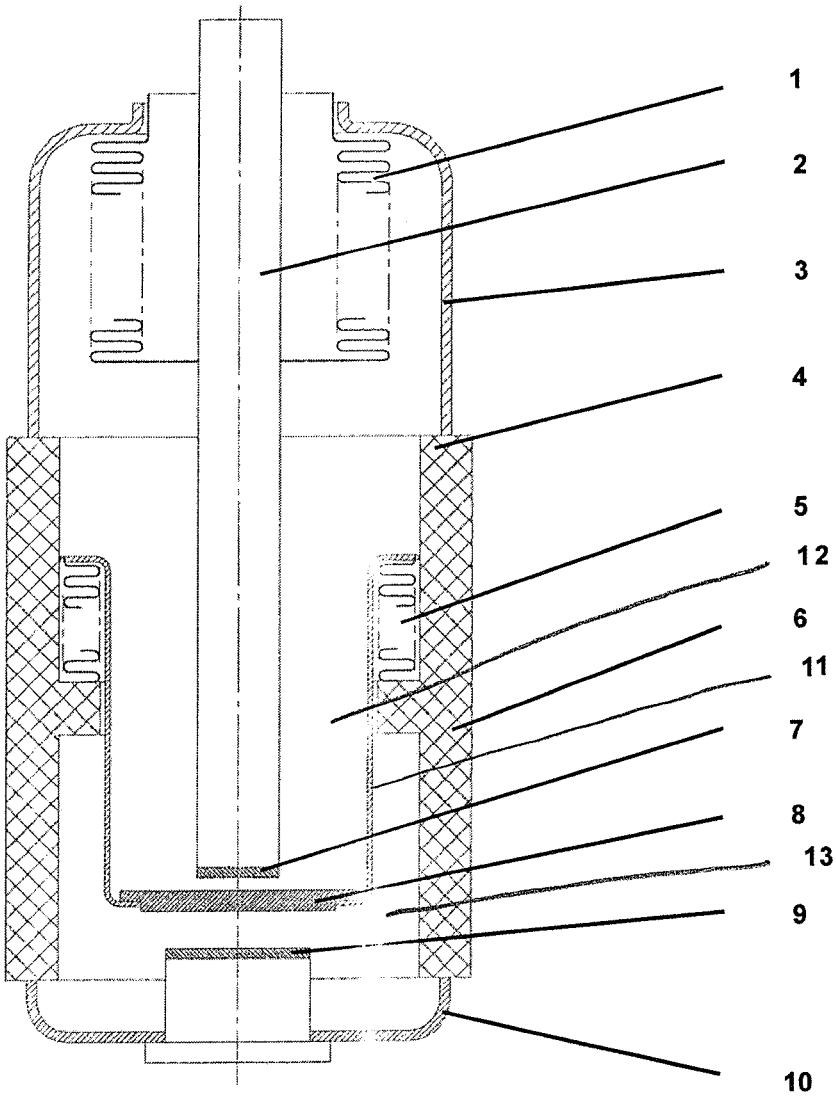
FIG. 2 shows a second exemplary embodiment of a load-interrupter circuit breaker.

FIG. 2 shows an exemplary load-interrupter circuit breaker with minor modifications from the illustration shown in FIG. 1. FIG. 2 therefore likewise shows a load-interrupter circuit breaker-vacuum interrupter chamber (3) with two integrated breaker gaps between the contact pieces (7-8 and 8-9). One side of the vacuum interrupter chamber (e.g., inner chamber (12)) is equipped with a moving supply line (2). The supply line (2) as well as the contact piece (7) can be moved within the vacuum interrupter chamber via a bellows (1). The isolation between the components (4) and ((10), fixed-contact side comprising a cover and a fixed-contact mount) of the vacuum interrupter chamber is provided by the isolator (6). During disconnection, the supply line (2) is first of all moved together with the component (8) which is arranged such that it can move in the vacuum interrupter chamber. The component (8) is connected to a spring component (5) via an edge flange on the isolator (6). The prestressing allows the contact movement (8-9). Once a preset contact movement of the breaker gap (8-9) has been reached, the breaker gap (7-8) opens and the second contact gap is opened.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A switching device comprising:

a vacuum interrupter chamber having a first moving contact piece and a second moving contact piece, the first moving contact piece being arranged at a first end, and a fixed contact piece arranged at a second end;

an isolator that isolates the first and second ends of the chamber from one another;

wherein the first moving contact piece, the second moving contact piece, and the fixed contact piece form two series-connected contact arrangements with a total of two contact levels which are configured to be opened are arranged within a vacuum interrupter chamber, wherein the first moving contact piece is positively directly driven via a drive, and the second moving contact piece is driven indirectly by a spring disposed and compressible on an edge flange of the isolator inside the chamber and is configured to move synchronously or lag in at least one operating direction.

2. The switching device as claimed in claim 1, wherein the drive is a common drive configured to act on the two series-connected contact arrangements.

3. The switching device as claimed in claim 1, wherein the two series-connected contact arrangements are formed via three contact pieces.

4. The switching device as claimed in claim 1, wherein the second moving contact piece, which is a synchronous or lagging contact piece, is electrically floating.

5. The switching device as claimed in claim 1, wherein the second moving contact piece, which is a synchronous or lagging contact piece, is surrounded by an arrangement in the form of a cup.

6. The switching device as claimed in claim 5, wherein the cup arrangement is integrally or at least firmly connected to the second moving contact piece.

7. The switching device as claimed in claim 5, wherein the cup arrangement is provided with an opening through which the second moving contact piece is secured, the second moving contact piece having effective contact faces on both sides.

8. The switching device as claimed in claim 1, comprising a supply line constituted by a material having a conductivity less than that of copper.

9. The switching device as claimed in claim 1, comprising at least two supplying lines made of copper.

10. The switching device as claimed in claim 1, comprising:

an inner interrupter chamber located within an outer vacuum interrupter chamber and the contact pieces are connected in series in a breaker gap of the inner and outer chambers.

11. The switching device as claimed in claim 1, wherein at least one of the contact pieces is made of a copper-chromium alloy.

12. The switching device as claimed in claim 1, wherein one of the contact pieces of one of the two series-connected contact arrangement is made of at least one of a tungsten-copper alloy and a tungsten-carbide-silver alloy, and contact pieces of another of the two series-connected contact arrangement are made of a copper-chromium alloy.

13. The switching device as claimed in claim 2, wherein the two series-connected contact arrangements are formed via three contact pieces.

14. The switching device as claimed in claim 2, comprising:

a supply line constituted by a material having a conductivity less than that of copper.

15. The switching device as claimed in claim 2, comprising:

at least two supplying lines made of copper.

16. The switching device as claimed in claim 9, comprising:

an inner interrupter chamber located within an outer vacuum interrupter chamber and the contact pieces are connected in series in a breaker gap of the inner and outer chambers.

17. The switching device as claimed in claim 2, wherein at least one of the contact pieces is made of a copper-chromium alloy.

18. The switching device as claimed in claim 1, wherein one of the contact pieces of one of the two series-connected contact arrangement is made of at least one of a tungsten-copper alloy and a tungsten-carbide-silver alloy, and contact pieces of another of the two series-connected contact arrangement are made of a copper-chromium alloy.

19. The switching device as claimed in claim 2, wherein the contact pieces of one of the two series-connected contact arrangement are made of at least one of a tungsten-copper alloy and a tungsten-carbide-silver alloy, and the contact pieces of another one of the two series-connected contact arrangement are made of a copper-chromium alloy.

* * * * *